United States Patent [19]

Symonds et al.

[11] 4,095,139

[45] June 13, 1978

[54] LIGHT CONTROL SYSTEM

[76] Inventors: Alan P. Symonds, 14 Bobsled Dr., Needham Heights, Mass. 02194; William K. Durfee, 3 Dana St., Apt. 8A, Cambridge, Mass. 02139

[21] Appl. No.: 798,259

[22] Filed: May 18, 1977

[51] Int. Cl.[2] ..... H05B 37/02; H05B 39/04

[52] U.S. Cl. ..... 315/153; 315/158; 315/293; 315/294; 315/315

[58] Field of Search ..... 315/154, 153, 158, 159, 315/291, 293, 294, 314, 315, 316

[56] References Cited

U.S. PATENT DOCUMENTS

| | | | |
|---|---|---|---|
| 3,265,932 | 8/1966 | Pettersson et al. | 315/293 X |
| 3,491,263 | 1/1970 | Isaacs | 315/293 |

*Primary Examiner*—Alfred E. Smith
*Assistant Examiner*—Charles F. Roberts
*Attorney, Agent, or Firm*—Schiller & Pandiscio

[57] ABSTRACT

A light control system for selectively controlling the light intensity levels of a plurality of light groups, each group including one or more lights, is disclosed. The system comprises a control for generating a parallel binary-coded signal representative of a predetermined current level to be applied to a particular light group; a signal generator for providing (1) a unique and predetermined serially-coded address signal corresponding to the particular light group and, (2) a serially-coded data signal representative of the current level in response to the parallel binary-coded signal, and; a plurality of receivers, at least one for each light group for applying the current level to the particular light group only in response to the address signal and data signal. A common wire bus for transmitting the address and data signals from the signal generator to each of the receivers is utilized to substantially reduce the wiring required.

15 Claims, 11 Drawing Figures

LIGHT CONTROL SYSTEM

This invention relates to light controllers and more particularly to theatre and television light dimming systems and the like.

Theatre light dimming systems are used to control a plurality of lights usually of different colors. The lights are connected to power dimmers so that the intensity of each of the lights can be controlled collectively, individually or in groups so as to provide a variety of different combinations of lighting levels for achieving a variety of different lighting effects (called lighting "cues"). Typically, each light or group of lights is selectively controlled through a power dimmer, which in turn is connected to an individual controller or operator switch. In such a system separate sets of wires typically run from the controllers, typically located on a control console board in a light operator's booth, in the rear of the auditorium through the power dimmer to each light or group of lights located on the stage. Thus, even for small and medium sized installations, usually found in high school and college auditoriums and community theatres, where there are about 50 power dimmers, a large amount of wiring is necessary to connect all of the lights with their respective power dimmers and in turn the power dimmers to the controllers.

Many commercially-available theatre light dimming systems employ a memory unit, in the form of banks or arrays of potentiometers, for storing cues. Typically, the control console includes switches for selecting a particular array of potentiometers. Accordingly, a light operator can present a cue, i.e., preset the light intensity of the lights controlled by each of the controllers by setting the potentiometers of one array of the memory unit. At the appropriate time, the operator can then switch the array of preset potentiometers into the circuit through the control console so that all of the lights on the stage are set at their appropriate level. By way of example, the system presently employed in the Loeb Drama Center in Cambridge, Mass., is provided with 52 controllers and power dimmers and employs 10 arrays of potentiometers as a memory unit. Thus, 520 potentiometers are employed which store up to 10 cues at any one time. The settings of each of the potentiometers for each cue are typically determined at rehearsal, with a lively production requiring as many as 200 lighting changes, some of the changes involving up to 150 lights. Due to the limited memory capacity of the arrays of potentiometers, it is therefore necessary that the operator set many of the cues during such a performance. Since he must set each of the potentiometers in each array separately, it can be demanding on the operator, particularly where several cues must be set in a relatively short period of time. Further, these 520 potentiometers (1) take up most of one wall in the operator's booth, and (2) create a great deal of heat as well as power loss. Additionally, these potentiometers are notorious for attracting dirt and breaking down under use.

It is a general object of the present invention to provide a light controller system which overcomes many disadvantages of the prior art system described.

More specifically, it is an object of the present invention to provide a light controller system in which the amount of wiring used to connect the control console to the individual power dimmers is substantially reduced.

Another object of the present invention is to provide a light controller system having a single bus to which any number of individually-controllable lights can be attached without appreciably increasing the amount of wiring.

Another object of the present invention is to provide an improved light dimming system in which an unlimited number of cues can be stored prior to the performance, and yet modifications to the cues can easily be effected during the performance.

Yet another object of the present invention is to provide a theatre light dimming system which can perform some of the same functions as the prior art system previously described, such as proportional mastering, dimmer control output and storage of lighting cues.

Still another object of the present invention is to provide an improved theatre light dimming system, operable from a light operator's booth, requiring a relatively small amount of space, generating little or no heat, and providing a greater immunity to a dirty environment.

A further object of the present invention is to provide an improved light control system with substantially less power consumption.

Another object of the present invention is to provide a light controller system having a single input control device bus to which any number of dimmer controllers can be attached without appreciably increasing the amount of wiring.

These and other objects are achieved by a light control system comprising improved control means for generating a first signal representative of a predetermined current level to be applied to a particular light group defined to include one or more lights. Signal generating means is provided for generating a unique and predetermined serial binary-coded address signal corresponding to the particular light group and a serial binary-coded data signal, responsive to the first signal and representative of the current level to be applied to the light group. Improved receiver means provides the predetermined current level to the particular light group only in response to the unique address signal. A common bus is utilized for transmitting the address signal and the data signal from the signal generating means to the receiver means. Information storage and retrieval means are employed for storing any desired number of cues.

Other objects of the invention will in part be obvious and in part appear hereinafter. The invention accordingly comprises the apparatus possessing the construction, combination of elements, and arrangements of parts which are exemplified in the following detailed disclosure, and the scope of the application of which will be indicated in the claims.

For a fuller understanding of the nature and objects of the present invention, reference should be had to the following detailed description taken in connection with the accompanying drawings wherein.

In the drawings, the same numerals are used to denote like parts.

Figure 1:
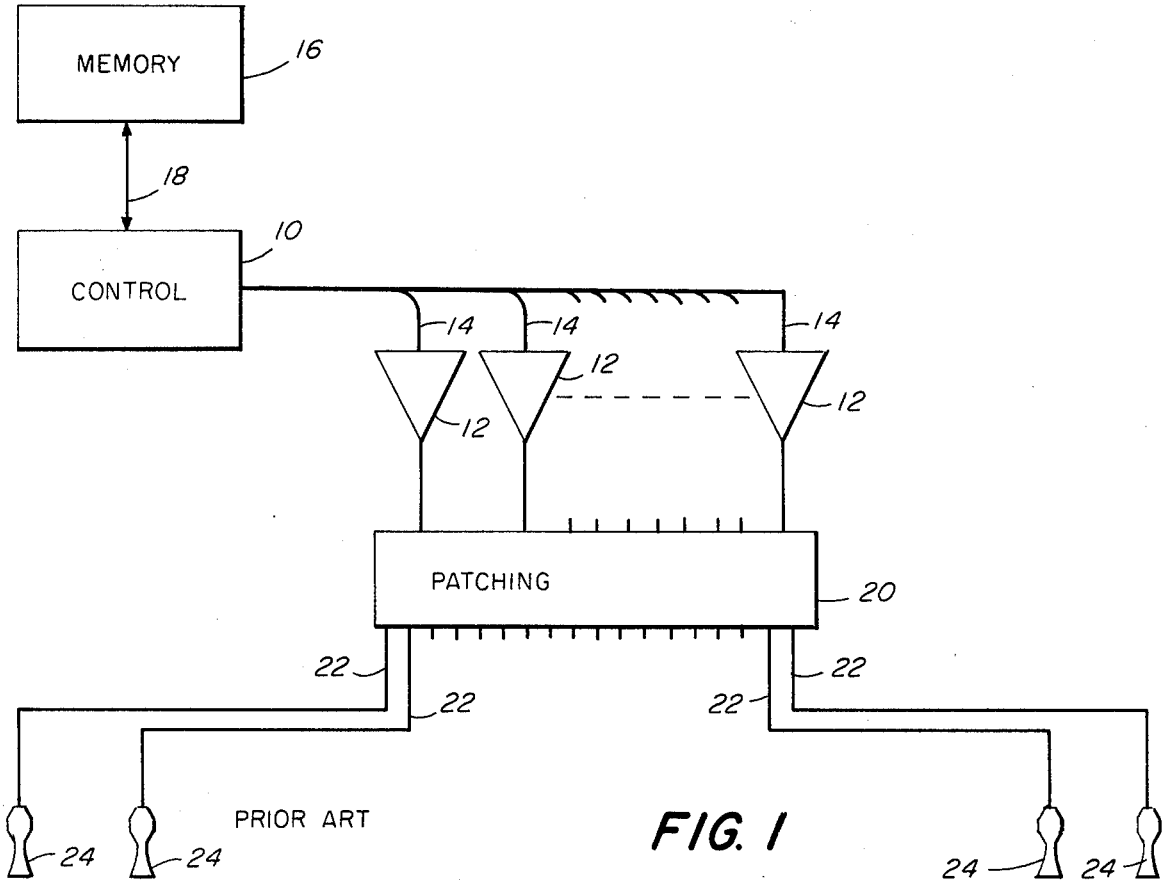
PRIOR ART FIG. 1
FIG. 1 is a block diagram of a prior art theatre dimming system.

Referring to FIG. 1 of the drawings, a typical prior art system is shown as including the memory 16 which is connected through conductors 18, control 10 and wires 14 to the power dimmers 12. The memory 16 includes a plurality of arrays of potentiometers (not shown) for storing cues, with a small to medium-sized system typically employing about 50 channels, one for each controller. Each array of the memory 16 includes an equal number of potentiometers. Control 10 allows the operator to select which array is connected into the system for delivering a predetermined amount of current to each power dimmer 12. The output of each of the power dimmers is connected through the patching network 20 and wires 22, to the individual loads 24.

This system has its disadvantages including (1) the memory 16 is limited in cue storage capacity; (2) the potentiometers of the memory attract dirt which can cause malfunctioning; (3) the potentiometers generate a large amount of heat providing a relatively large power consumption loss and (4) the setting of the potentiometers can involve a great effort on the part of the operators. Further, the amount of wiring required is rather large, since the required number of wires 14 are equal to the number of channels plus one for ground, and expensive since each of the wires 22 are typically of a large gauge so that they can carry up to 50 amps and are wired from the centrally-located network 20 to the various loads 24 at various locations in the theatre.

Figure 2:
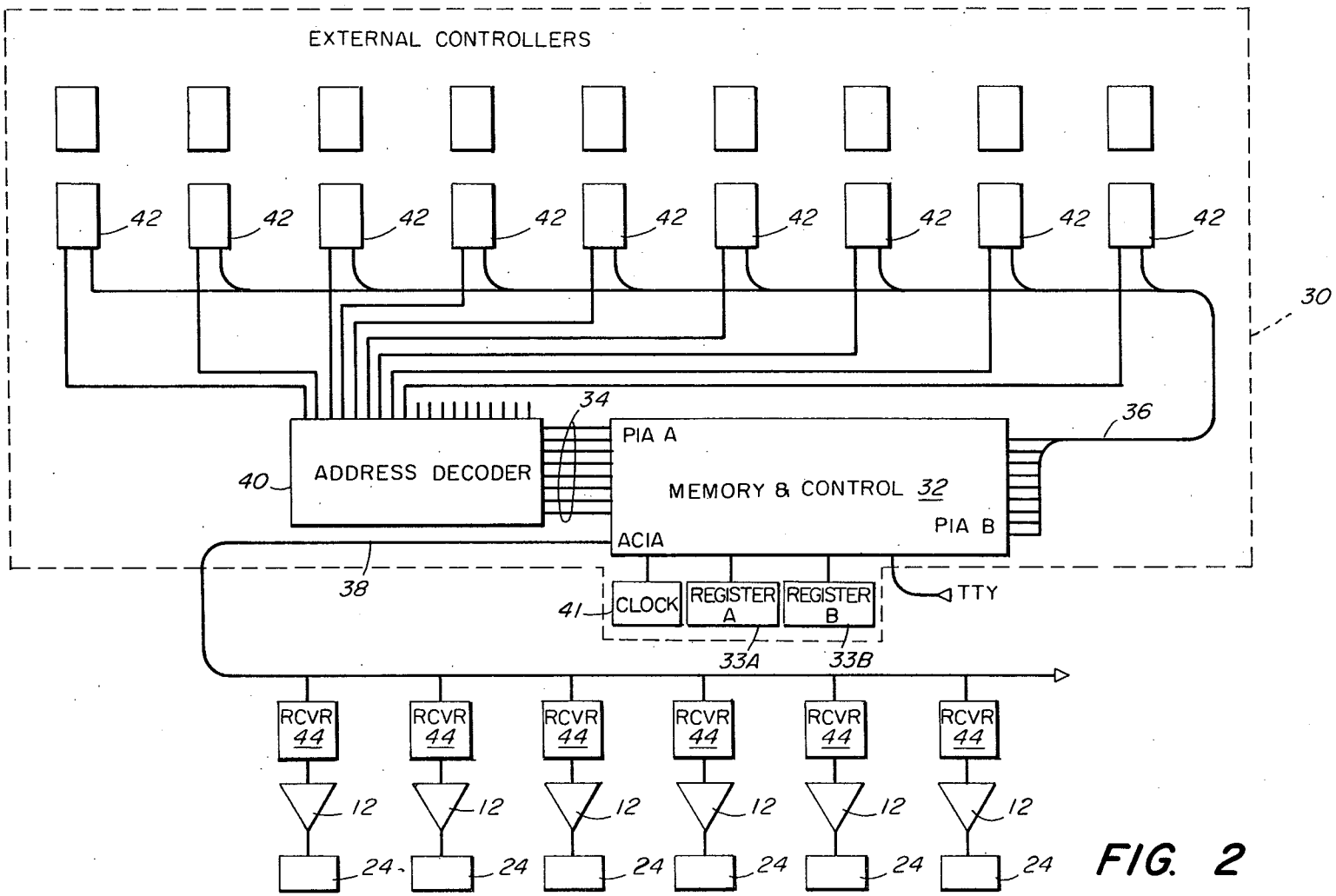
FIG. 2 is a block diagram of the preferred embodiment of the present invention.

In accordance with the present invention, these, as well as other disadvantages which may be apparent to those skilled in the art, are substantially overcome by the light control system shown in FIG. 2. The system of FIG. 2 performs all of the functions of the traditional system of FIG. 1, e.g. proportional mastering, dimmer control output and storage of sets of lighting levels (cues). The system includes a memory and control system 32 which is preferably contained in a single console unit, generally designated 30, so as to minimize space requirements and reduce heat and power losses encountered in the prior art system of FIG. 1.

The memory and control system 32 of unit 30 is preferably in the form of an information storage and retrieval system making possible the ability to store an indefinite number of cues and perform all of the necessary control functions. System 32 may be any one of several types of systems known in the art. For example, a microprocessor such as the one provided in the Design Evaluation Kit M6800 manufactured by Motorola, or a dedicated computer such as a PDP-11 manufactured by the Digital Equipment Company of Massachusetts can be used. For a discussion of the M6800 microprocessor and the PDP-11, see for example, Sovcek, Branko, *Microprocessors and Microcomputers,* John Wiley and Sons, 1976, pp. 299–340 and pp. 469–513, respectively. The type of system used is largely dependent upon the capacity desired. Therefore, for purposes of illustration and for ease of understanding, the present invention and in particular system 32, will be described with respect to the Motorola Design Evaluation Kit, M6800. This system includes a microprocessor which can be programmed to carry out the functions enumerated hereinafter. The microprocessor is designed so that a variety of logical and arithmetic operations may be performed on or between the two accumulator registers including additions, subtractions, logical AND's, OR's, compares, compliments, tests and shifts. Four dedicated registers (not shown) are used in the control of the system: a program counter, an index register, a stack pointer, and a condition code register. These are generally controlled by the microprocessor logic, although they may be used or altered under program control.

System 32 also includes a ROM (read only memory) commonly referred to as MIKBUG by Motorola. This ROM contains a program provided by the manufacturer which allows a programmer to communicate with the processing unit 32. The program allows user programs and data to be stored in memory, the working registers to be examined, and the execution of the user program to be supervised. System 32 also includes RAMs (random access memories). The number of RAMs required is dependent upon the storage capacity desired. Two RAMs are provided in the Motorola kit as well as means for attaching additional RAMs. Two segments of the RAMs, designated separately in the drawing as registers 33A and 33B are used to store two active cues, the purpose of which will be made more apparent hereinafter.

Figure 10:
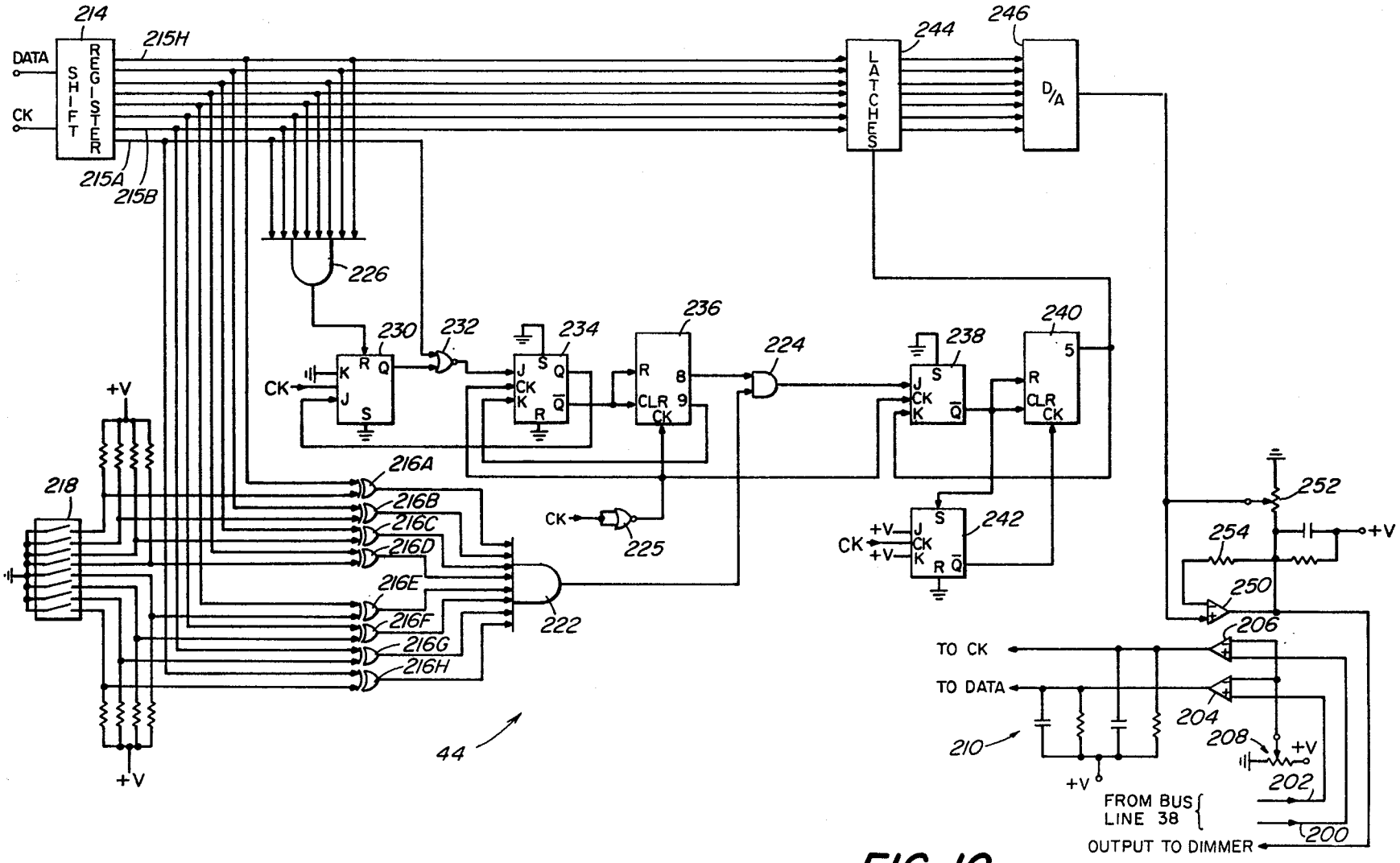
FIG. 10 is a circuit schematic diagram of the receiver of the present invention.
Figure 11:
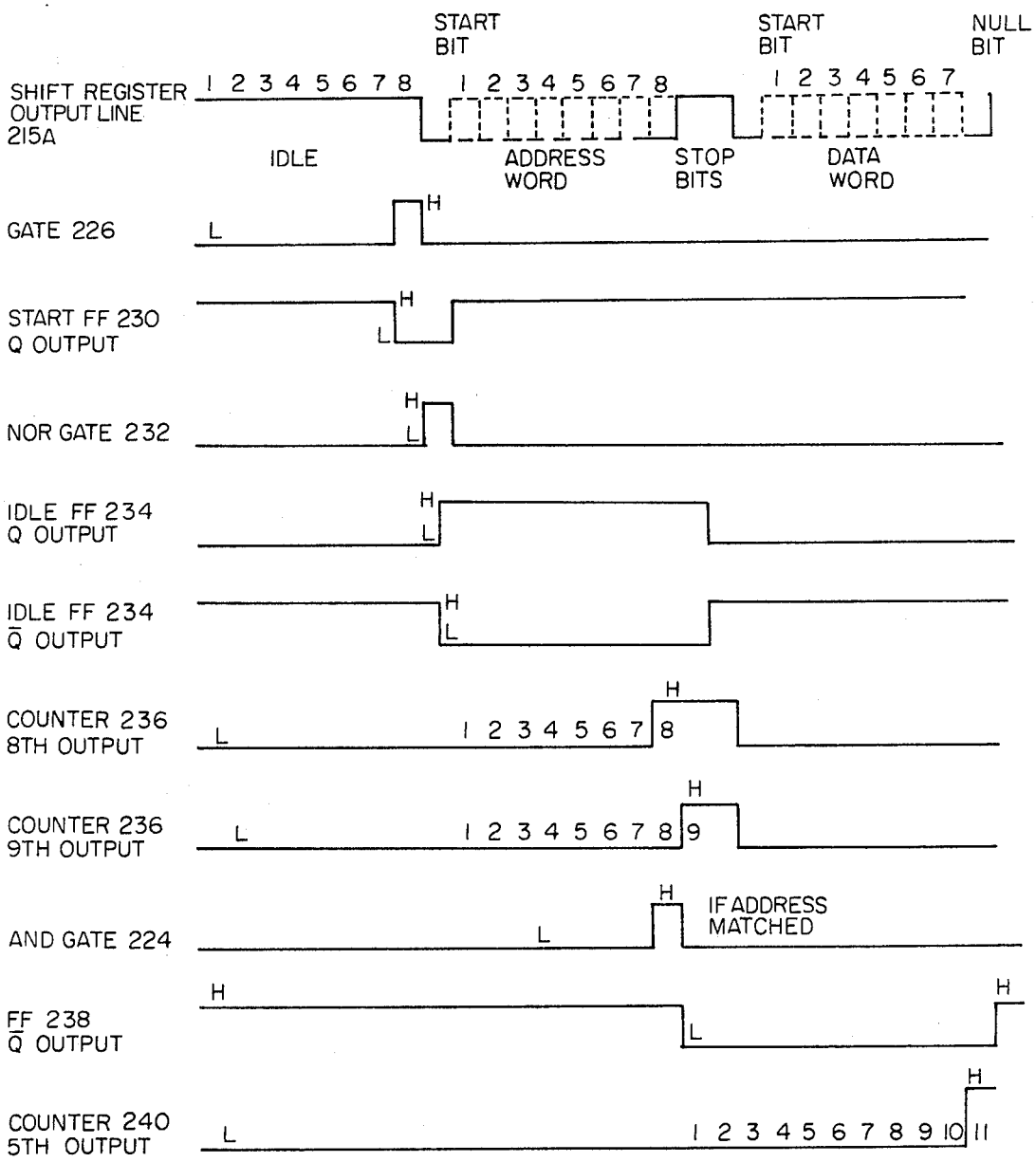
FIG. 11 is a timing diagram on a common time base useful in describing the operation of the receiver of FIG. 10.

The microprocessor system 32 communicates with the other elements of the light control system over three buses 34, 36 and 38. The components of the system 32 are connected to the address bus 34 through one-half of a Peripheral Interface Adaptor (PIA), designated A, while the system is connected to the data bus 36 through the other half, PIA B. The PIA, being part of the Motorola kit, serves the function of allowing the input and output of data to and from the components of the microprocessor system. The microprocessor is programmed to essentially instruct the PIA A which channel to look for by providing a binary-coded output to the address decoder 40. Decoder 40 preferably is a binary one-out-of-10 decimal converter which produces enable signals to the particular external peripheral devices 42 (which include the various switches and preset selector as described hereinafter) addressed. The system 32 is thus ready to receive data over data bus 36. The data is received over bus 36 through the PIA B. The address bus is thus designed so that the peripheral devices respond to particular addresses. The data bus 36 handles transfers between the peripheral devices and the microprocessor. Each PIA is adapted to handle two channels of 8-bit parallel data. In each channel, a buffer register is connected to the data bus. One memory address connects the buffer to a condition code register, which can be read or changed by the microprocessor. This sets the data direction format, and determines whether or not the PIA can interrupt the data processor. The next sequential address activates the data register, the latter doing the actual communicating. The Motorola microprocessor also uses a PIA to handle communication with a teletype machine indicated generally as TTY. The latter provides an input and output to the memory so as to change the program if desired. Finally, the system 32 is connected to signal bus 38 through the Asynchronous Communications Interface Adaptor (ACIA), the latter being included in the Motorola kit. Like the PIA, the ACIA has a control and a data register wired to different addresses. The ACIA of the kit requires an external signal clock 41. By way of example, a crystal-controlled baud rate generator is a suitable clock although other clocks can be used. In addition to providing a clocking signal to the ACIA, the clock 41 also provides a clocking signal over one of the wires of the bus 38 and is used to transfer the signals over another wire of the bus 38. In the output mode, the ACIA receives a data word from the microprocessor and transfers it into the data register. The condition codes determine the trnsmitting rate, and the number of start, stop and parity bits required (as will become more apparent hereinafter in connection with FIG. 11). The complete word is shifted out of the register over bus 38 at the given clock rate. Once transmission is begun over bus 38, one of the condition code bits is changed to indicate that the ACIA is able to accept another data word. The program of the microprocessor always checks this bit before attempting to load the ACIA. In this way, the ACIA is used to transmit word sets, each of which comprises an ADDRESS word and a DATA word (both words being in the form of serial binary-coded signals) to the individual receivers 44. Each receiver 44, described in greater detail with reference to FIGS. 10 and 11, is adapted to examine each word set and applies a current level represented by the DATA word to the particular power dimmer 12 only when the DATA word is accompanied with the unique ADDRESS word to which the particular receiver is responsive. Thus, different current levels can be selectively applied to the individual loads 24 over the common bus 38 by addressing the particular current level to the desired receiver or receivers.

Figure 3:
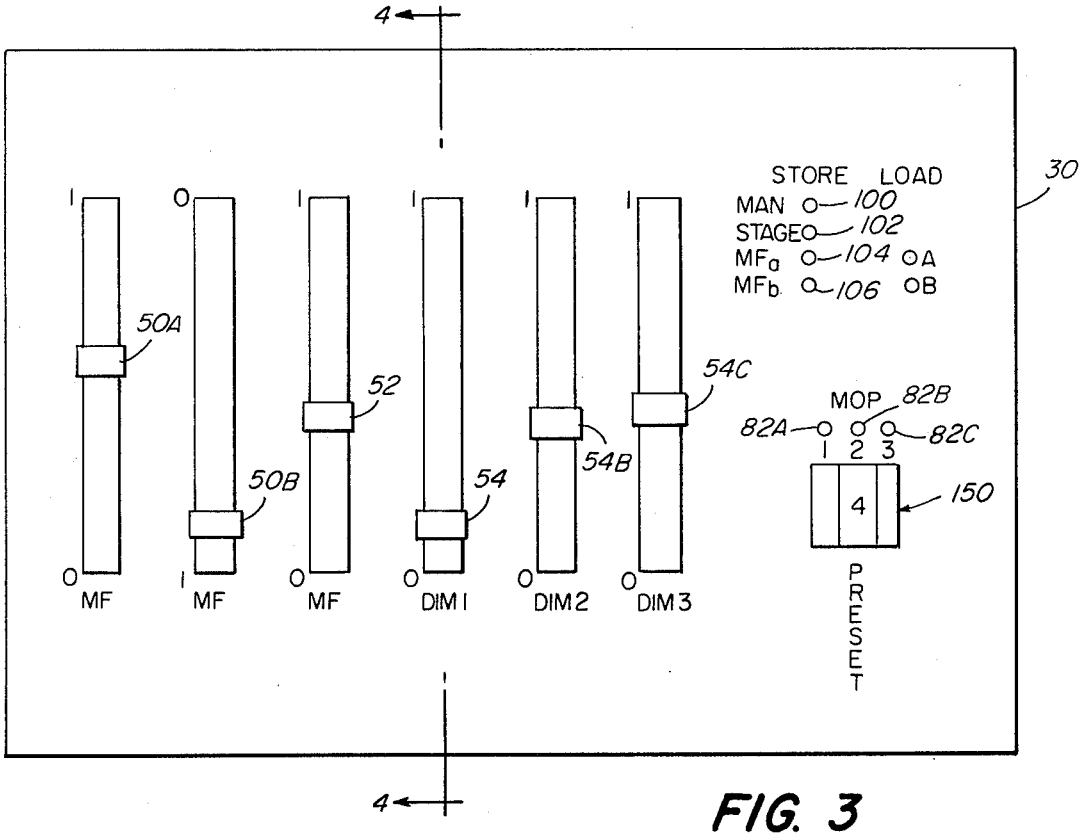
FIG. 3 is a front view of the control console of the FIG. 2 embodiment.
Figure 5:
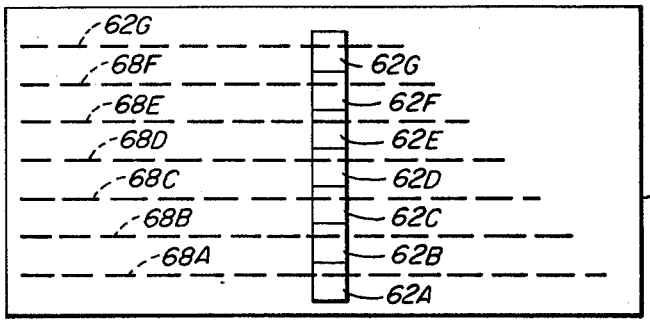
FIG. 5 is a partial plan view taken along lines 5—5 of FIG. 4.
Figure 4:
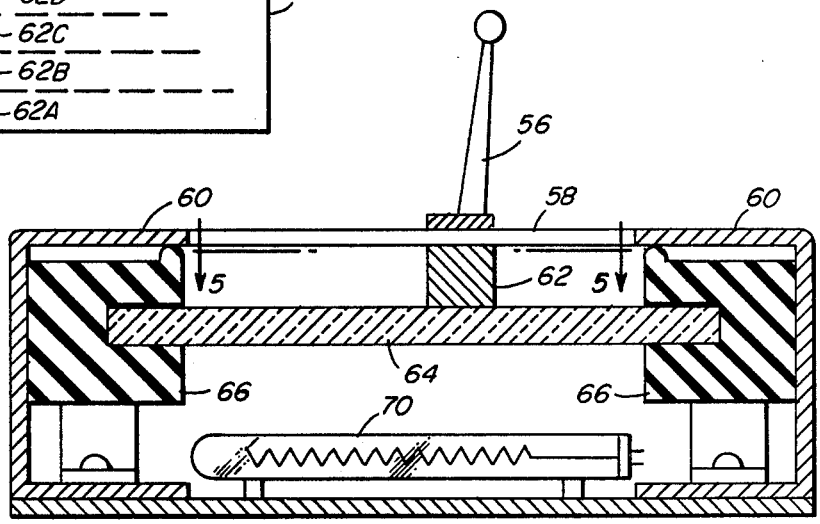
FIG. 4 is a cross-sectional view taken along line 4—4 of FIG. 3.

Referring to FIGS 3–5, the control and memory unit 30 is described in greater detail. The unit comprises various peripheral devices including master faders (MF*a* and MF*b*) 50A and 50B, a manual master fader 52 and individual dimmer controllers or switching means 54, one for each power dimmer 12. Only three controllers 54 are shown for ease of exposition but it will be appreciated that any number of controllers can be employed depending on the number of individual power dimmers that are to be selectively controlled. Thus, each controller 54 is used to control the setting of the light intensity level of a light group, whether the setting of that particular light group is to be stored in the unit 32 or used to directly control the light group on the stage. As will become more evident, hereinafter the manual master fader 52 is used to manually control the light intensities of the light groups on stage while the master fader 50A and 50B are used to control the light intensities of the light groups on the stage through the registers 33A and 33B reqpectively of the unit 32. The faders 50 and 52 are controllers 54 are constructed substantially identically as shown in FIGS. 4 and 5 (with the exception that fader 50A is mounted oppositely to fader 50B). Each fader 50 and 52 and controller 54 includes a handle 56 extending from the exterior the unit 30, where it can easily be grasped by the operator, through a slot 58 provided in the face plate 60 of the unit where it is attached to an array of photosensitive elements 62 within the unit (see FIG. 4). The elements 62 are adapted to convert light energy into electrical energy. The array of photosensitive elements 62 preferably comprise seven phototransistors mounted adjacent one another in a linear array, although it will be obvious that more or fewer elements can be used as well as other types of sensing devieces. The handle 56 and elements 62 are suitably mounted in the unit so that the handle can be manually moved in the slot 58 parallel to the face plate 60 with the level of intensity of the lights being controlled gradually changing from zero to some full predetermined level as the handle is moved from a first (hereinafter indicated as 0) to a second (hereinafter indicated as 1) position.

A photomask 64 is mounted within the unit 30 by suitable supports 66 so that the photomask is positioned adjacent the elements 62, parallel to the movement of the latter. The photomask is preferably a glass or plastic sheet having a layer of opaque material disposed on one side. The layer of opaque material is provided with light transmitting slits or tracks 68 (see FIG. 5). Although not shown in explicit detail, the tracks 68 are preferably arranged in what is commonly known as a Gray code pattern. Gray codes are generally well known in the art. For example, see Fink, Donald G., *Electronics Engineers Handbook,* McGraw-Hill Book Company (1975) pp. 22–23, 24 and 29. Sepcifically, the tracks provide analog-to-digital conversion of the position of the array of elements 62 with respect to the tracks 68. The tracks are disposed parallel to one another and to the direction of movement of the photosensitive elements 62. Each track is disposed adjacent to a corresponding one of the elements 62 along a preselected portion or portions of the path of the element. The tracks transmit light from the light source 70 positioned below the photomask 64 to the elements 62 so as to divide the positions of the array of photosensitive elements 62 into a plurality of discrete positions, the number of which equals $2^n$ where $n$ equals the number of elements 62. Thus, by way of example, where seven elements are used, as the handle 58 is moved from the 0 position to the 1 position, the array of photosensitive elements moves through 128 discreet positions. In the 0 position, none of the tracks transmit light to the photosensitive elements 62 so that the light group being controlled is set at zero intensity. As the handle 56 and the photosensitive elements 62 are moved to the end, the first incremental change is such that only the track 68A is transmissive transmitting light to the photosensitive element 62A so that the latter provides an electrical signal. This represents the number 1 in Gray form. In this position none of the other photosensitive elements 62B–G will receive light and thus will not generate electrical signals. At the next incremental position only the tracks 62A and 68B will be transmissive thereby energizing photosensitive elements 62A and 62B so that the latter generate electrical signals. This represents the number 2 in Gray form. In this position none of the other photosensitive elements 62C–G will receive light and thus will not generate electrical signals. At the next incremental position only track 68B will be transmissive so that photosensitive element 62B generates an electrical signal while elements 62A and 62C–G do not. This represents the number 3 in Gray form. Accordingly, the elements 62A–G represent bits of information corresponding to a Gray code indication of the positions of the elements 62. Although other patterns can be used with greater or fewer increments (by increasing or decreasing the number of elements 62 used) it was found that a pattern approximately 10 centimeters long having 127 increments was adequate to insure that enough light was transmitted through the particular tracks to energize the corresponding photosensitive elements providing very clean switching with no problems arising from oscillation.

Each controller includes means for converting these Gray-coded signals to a parallel binary-coded set of signals and means selectively enabled by system 32 so as to instruct the system 32 as to the position setting of the controller. The means can be in the form of software, in system 32, so that the Gray-coded signals are transmitted directly to system 32 and converted to binary form. The preferred means for converting the Gray-coded signals to parallel binary-coded set of signals is, however, in the form of hardware and shown in FIG. 6. In the case of the controllers 54, means are also provided for selectively directing the setting of the particular controller to either directly control the light group controlled by the particular controllers 54 or storing the setting in system 32. The output of each of the elements 62 is preferably shaped by applying the signals from the elements to suitable signal conditioning means such as Schmidt triggers. Schmidt triggers are well known in the art and may take various forms. As shown, the triggers are each in the form of a NAND gate 74. The gates 74A–74G, each provide a sharp on-off transmission to provide a more sharply defined signal when the respective photosensitive element is energized. An eitht NAND gate 74H is provided which shapes an ENABLE signal (the purpose of which will be described hereinafter) received from the PIA A of the system 32. The output of each NAND gate 74 is transmitted through a gray-to-binary decoder 76. Such decoders are well known in the art. In the preferred embodiment decoder 76 includes eight exclusive OR (EXOR) gates 78A–H.

The outputs of each of the gates 74A–F and H are applied to an input of the respective EXOR gates 78A–F and H of the converter 76 while the input of EXOR gate 78F is adapted to receive the output of gate 74G. The output of EXOR gate 78B is connected to the other input of EXOR gate 78A and the output of EXOR gate 78C is connected to the other input of EXOR gate 78B. Similarly, the other input of EXOR gate 78B is connected to the output of EXOR gate 78C, the output of EXOR gate 78E is connected to the input of EXOR gate 78D, the output of EXOR gate 78F is connected to the input of gate 78E. One input of EXOR gate 78G is connected to a positive voltage while the other input of gate 78G in the case of the master fader switches 50 and master manual fader 52 is connected to ground (not shown). In the case of each of the controllers, the other input of gate 78G is connected to pole 1 of the corresponding MOP switch 82 (to be described hereinafter in reference to FIG. 7). The output of EXOR gate 78G is connected to an input of NAND gate 74H. The output of NAND gate 74H is connected to the input of EXOR gate 78H. The output of the latter provides the enable signal E.

As will be more evident hereinafter, the output signal E of gate 78H, is at a logic high if the PIA enable line is high and in the case of controllers 54, the MOP switch is not in the off position. A manual-off-preset (MOP) switch 82 (shown in FIG. 3 and in greater detail in FIG. 7) is provided for each controller 54 and preferably is a double pole, double throw center-off switch which has three positions: manual, off and preset. (1) When the MOP switch 82 is placed in the manual position the corresponding controller 54 directly controls the power dimmer, (2) when switch 82 is placed in the preset position the power dimmers are controlled by the values stored in the memory of system 32 in conjunction with master faders 50 and (3) when the MOP switch is placed in the off position the controller will have no effect on either the values in the working registers or the lights on the stage. As shown in FIG. 7 (1) when MOP switch 82 is in the manual position pole 1 is low and pole 2 is high, (2) when in the preset position, both poles are low and (3) when in the off position pole 1 is high. Returning to FIG. 6, the outputs of the gates 78 of the gray-to-binary code converter 76 are connected to a set of control, open-collector NAND gates indicated as 80A–H. All of the gates 80A–80H have an input connected to receive the enable signal E from the output of NAND gate 78H. Thus, the gates can only be enabled when the PIAA enable is high and the MOP swtich is either in the manual or preset position so that the MOP pole 1 line is low. Gates 80A–80F each have their other input connected to receive the outputs of EXOR gates 78A–78F, respectively. The other input of gate 80G is connected to the ouput of the NAND gate 74G while the other input of NAND gate 80H is connected to receive the signal from the MOP switch pole line 2. The outputs of the gates 80 thus provide an 8-bit parallel binary signal which appears on bus 36. Each of the first seven lines indicated as 0–6 are high or low depending on whether sensors 62A to 62G are energized. The eighth bus line indicated as 7 will be low if the MOP switch is set on manual while it will be high if the MOP switch is set on preset. In this way the line 7 of the bus tells the microprocessor of system 32 what to do with the data on bus lines 0–6, i.e. either to direct it to the working register for subsequent storage or to the lights on the stage. It is noted that if the MOP switch is off, the MOP pole line 1 will be high and therefore the output of NAND gate 74H will remain low regardless of whether the PIA enable line is high or low.

Figure 6:
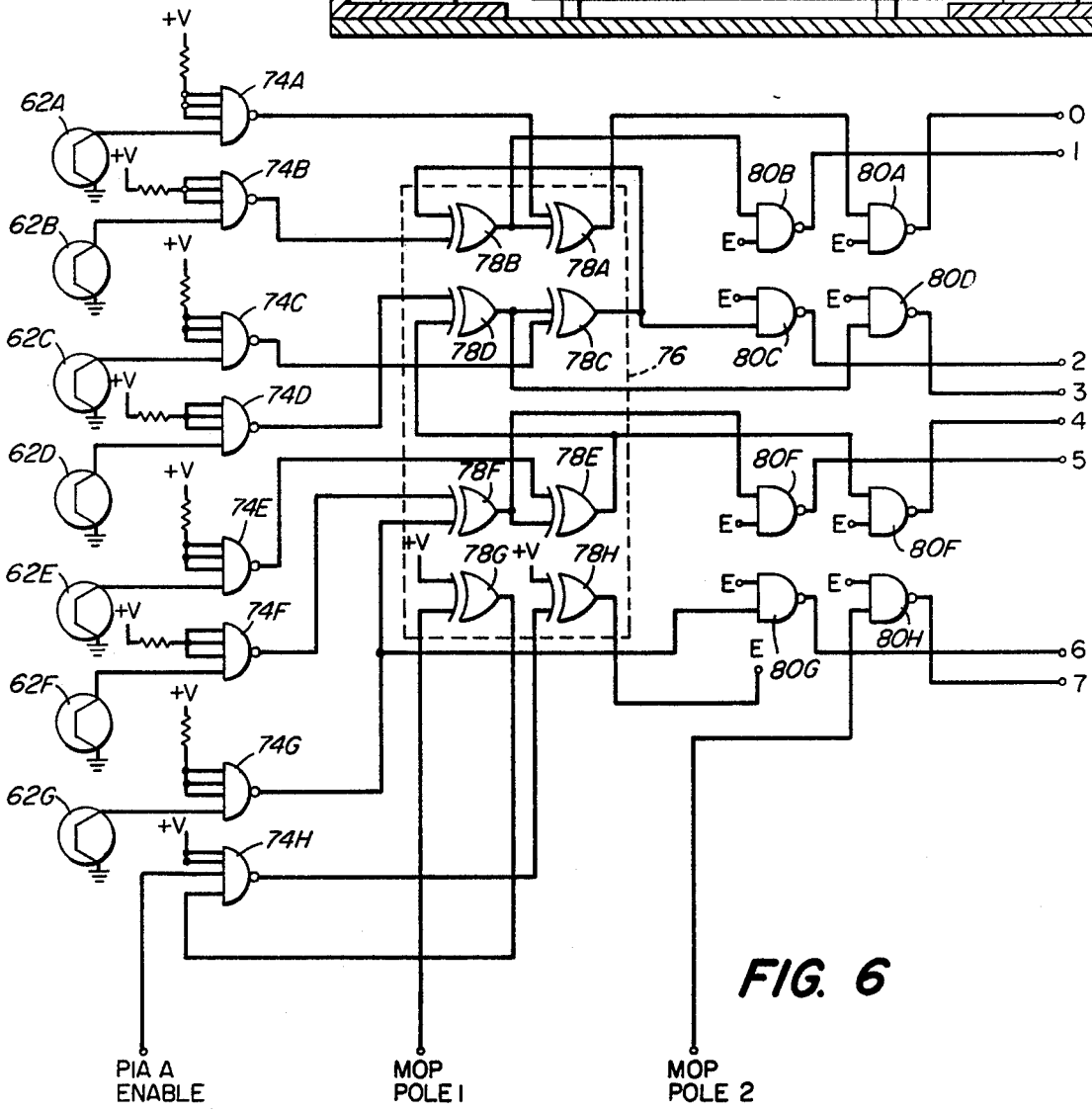
FIG. 6 is a circuit schematic diagram of the optical fader and dimmer control switches.
Figure 7:
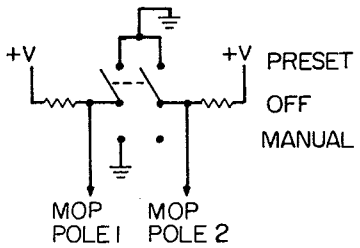
FIG. 7 is a circuit schematic diagram of the manual-off preset switches.

It will be appreciated that since the master faders 50A and 50B and the master manual fader 52 are not provided with MOP switches, the circuitry of these faders 50 and 52 are identical to that of the controllers 54 shown in FIG. 6 except that the MOP pole line 1 is connected to ground to provide a low signal input to EXOR gate 78G and the NAND gate 80H is not used. Thus, only a seven line output is provided (indicated by lines 0–6) to the system 32. When setting a particular light intensity with any of the faders 50 or 52 or controllers 54, the handle 56 of the particular controller is moved between the 0 and 1 positions depending on the light intensity level desired. By moving the handle 56 of the particular controller, various combinations of the photosensitive elements 62 are energized. When the desired intensity is achieved, the array of elements 62 are left in a fixed position relative to the photomask 64.

By way of example, as shown in FIG. 6, if only phototransistor 62A is energized, the output of NAND gate 74A will go high while the outputs of NAND gate 74B–G will remain low. This results in the output of EXOR gate 78A of the Gray-to-binary decoder 76 and thus the input to NAND gate 80A to go high while the remaining outputs of the encoder remain low. In the case of controller 54, where the MOP switch is set on manual, pole line 1 will be low and pole line 2 will be high, while in the case of the faders 50 and 52, line 1 is low and line 2 is not used. In either case, the output of the EXOR gate 78G thus is high enabling gate 74H when the PIA A enable signal is received from the system 32. When the gate 74H is enabled, the output of the gate goes low enabling gate 78H of the decoder 76 providing the enabling signal to the NAND gates 80. Since gates 80A (in both cases) and 80H (in the case of controllers 54) are the only two gates enabled in the example given the output lines 0 (in both cases) and 7 (in the case of controllers 54) of the bus will go low while the remaining lines will remain high. Since the output of gate 80H (in the case of the controllers 54) and thus line 7 of the bus goes low, the system 32 is instructed that the MOP switch is set on manual and the signals provided on the bus from the controller are to be applied directly to the light group.

In the case of the controllers 54 where the MOP switch is set on preset, the MOP pole line 1 will remain low, as previously described, so that when the PIA A enable signal is provided, the output of the EXOR gate 78H will go high to enable those NAND gates 80 having their other input in a high state. However, when the MOP switch is in the preset condition, pole line 2 will be in a low state so that NAND gate 80H will not be enabled and, thus line 7 of the bus will remain high.

Finally, in the case of the controllers 54, when the MOP switch is in the off position, the pole one line will be in a high state. This disables the exclusive OR gate 78G so that the output of NAND gate 74H remains high regardless of the PIA A enable signals received at its input. Thus, the output of the exclusive OR gate 78H will remain low and the NAND gates 80 will not be enabled.

Figure 8:
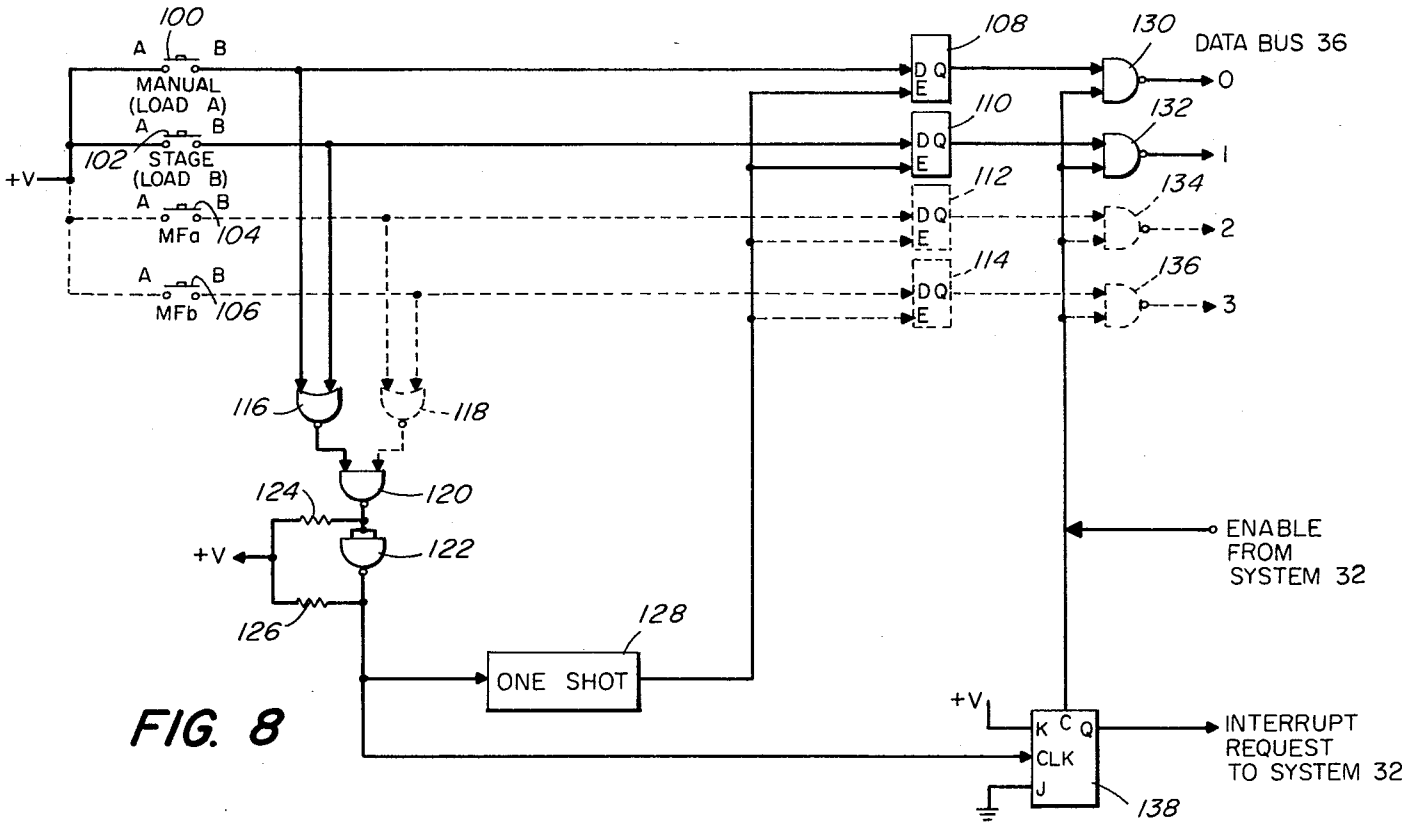
FIG. 8 is a circuit schematic diagram of the store and load controls.

Referring again to FIG. 3 and more particularly to FIG. 8, in order to store particular cues in the microprocessor of system 32, a store switching circuit comprising four store switches is provided. All the switches are shown as the push-button type, however, it will be obvious to those skilled in the art that other types of switches are equally satisfactory. As will be more evident hereinafter: (1) the manual store switch 100 is pushed when it is desired to store those values provided by the setting of each of the controllers 54; (2) the stage store switch 102 is pushed when it is desired to store those lighting values currently on the stage; (3) the MF*a* store switch 104 is pushed when it is desired to store the values of the intensity levels of those light groups in the storage register 33A of unit 30 multiplied by the proportional setting (0–1) of the MF*a* fader 50A; and (4) the MF*b* store switch 106 is pushed when it is desired to store the values of the intensity levels of those light groups in the storage register 33B of the unit 30 multiplied by the proportional setting (0 to 1) of the MF*b* switch 50B. One terminal indicated as A of each of the switches is connected to a positive voltage source while the other contact indicated as B or each of the switches is connected to the D input of the corresponding D-type flip-flops 108, 110, 112 and 114, respectively. The B terminals of the switches 100 and 102 are connected to the NOR gate 116 while the B terminals of switches 104 and 106 are connected to the inputs of NOR gate 118. The outputs of NOR gates 116 and 118 are connected to the input of NAND gate 120. The output of the latter is connected to the input of NAND gate 122. the outputs of NAND gates 120 and 122 are biased through resistors 124 and 126, respectively, by a positive voltage source. The output of NAND gate 122 is also connected to the input of one-shot 128. One-shots are well known in the art and generally are a class of multivibrators. One-shot 128 is designed so that when the output of NOR gate 122 provides a negative going transition (a change from a high logic state to a low logic state) after a predetermined period of time, the one-shot provides a positive going transition (a change from a low logic state to a high logic state). This positive going transition output of one-shot 128 is provided to the E inputs of the flip-flops 108, 110, 112 and 114. The Q outputs of flip-flops 108, 110, 112 and 114 are connected to an input of the respective NAND gates 130, 132, 134 and 136. The output of NAND gate 122 is also connected to the clocking input of the J-K flip-flop 138. The K input of flip-flop 138 is connected to a positive voltage source while the J input is connected to ground. The Q output of J-K flip-flop 138 provides an interrupt request signal to system 32 when a negative-going transition is provided at the clocking input of flip-flop 138. System 32 provides an enable signal to the clearing input of J-K flip-flop 138 as well as to the input of each of the NAND gates 130, 132, 134 and 136. The output of NAND gates 130, 132, 134 and 136 provide a 4-bit parallel signal output over bus line 36.

In the steady state condition when none of the switches 100, 102, 104 and 106 are pushed, it will be appreciated that the inputs to NOR gates 116 and 118 are all low and the output of the two gates are high. The output of gate 120 accordingly is low and the output of NAND gate 122 is high. Since the output of one-shot 128 is only high when the output of NAND gate 122 provides a negative going transition, the output of one-shot 128 will be low so long as the output of NAND gate 122 remains high. Similarly, the same negative-going transition from NAND gate 122 provides a high clocking input to the J-K flip-flop 138. In this condition, the Q output of the J-K flip-flop 138 will go high providing an indication to the system 32 that one of the switches has been pushed. When so indicated, system 32 provides a high signal over the enable line so as to clear the J-K flip-flop 138 and to enable the appropriate NAND gate 130, 132, 134 or 136.

Specifically, by way of example, if it is desirable to store those values of the light levels provided by the setting of the controllers 54, switch 100 is pushed providing momentary contact between terminals A and B of the switch so that a high pulse signal is generated. This high pulse signal is applied to the D input of the D flip-flop 108 and is also applied to the input of NOR gate 116. The output of NOR gate 116 accordingly changes from a high to a low signal. This provides a low signal to the input of NAND gate 120 so that the output of NAND gate 120 goes from low to high. NAND gate 122 acts as an inverter and inverts the high output of NAND gate 120 to provide a negative going transition at its output. This transition triggers the one-shot 128, which after a short delay produces a low to high transition at its output. The output of one-shot 128 thus enables the D flip-flop 108 whose high input now appears at its Q output and at an input to NAND gate 130. The negative-going transition output of the NAND gate 122 is also provided to the clocking input of the J-K flip-flop 138, which in turn provides the (high) interrupt signal to system 32. System 32 thereby provides the enable signal (1) to the clearing input of the J-K flip-flop 138 so that the Q output of the latter changes from a high to a low state and (2) to the NAND gate 130 (both of the inputs now being high) so that the output of NAND gate 130 changes from a high to a low state. The output of gate 130 remains low for the duration of the enable signal from system 32 and then returns high. In this way, a negative going pulse is provided over the zero line of the data bus 36 indicating that switch 100 has been pushed. The system then provides the PIA enable signal to each of the controllers 54 as shown in FIG. 6. In a similar manner, pushing switches 102, 104 and 106 provide a similar low pulse over the lines 1, 2 and 3 of the bus line 36 respectively so that the appropriate signal levels of the lighting groups can be stored.

In order to load particular cues from storage into registers 33A and 33B of the microprocessor, two load switches are provided. These load switches operate in the same manner as the store switches except that since only two switches are necessary, the FIG. 8 circuit can be modified by eliminating switches 104, 106, the flip-flops 112 and 114, NOR gate 118 and NAND gates 120, 122, 134 and 136. As shown, switch 100 is used as load switch A, hereinafter referred to as switch 100A, and switch 102 is used as load switch B, hereinafter referred to as switch 100B. Accordingly, a two line output is provided over bus line 36 to indicate whether a particular setting is to loaded into register 33A or register 33B.

Figure 9:
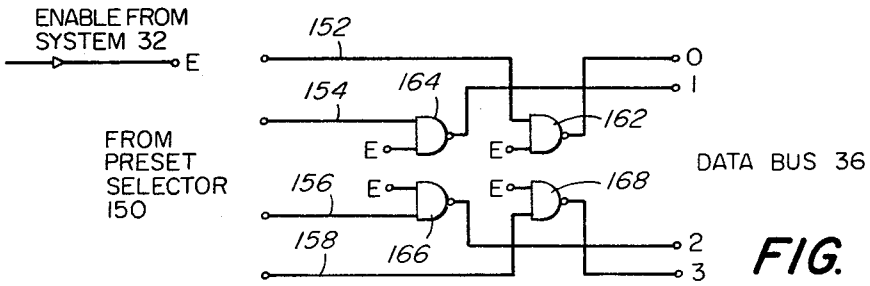
FIG. 9 is a circuit schematic diagram of the preset selector.

In order to instruct the microprocessor unit 32, the controlled unit is provided with a preset switching selector 150 (see FIG. 3) in which the unit can be instructed as to which cue is either to be used for storage or to be loaded into the registers. For example, a thumb wheel switch providing an octal type output may be utilized to provide eight outputs indicative of eight corresponding positions of the thumb wheel switch. Such a switch is connected to the circuit shown in FIG. 9. Each of the output lines indicated at 152, 154, 156 and 158 are connected to an input of the respective NAND gates 162, 164, 166 and 168. The other inputs of the NAND gates 162, 164, 166 and 168 are adapted to receive an enable signal from microprocessor unit 32. Accordingly, when the enable signal is received providing a high input on the enable inputs of NAND gates 162, 164, 166 and 168 the output of the NAND gates will go low if the corresponding input of lines 152, 154, 156 and 158 is also high. Thus, the output of NAND gates 162, 164, 166 and 168 is a parallel binary coded signal indicating the particular position of the preset selector. This information is transmitted over bus 36 to the microprocessor system 32 of the unit 30 when the enable signal is provided.

It will be apparent that as many preset selector switches may be provided as are required by the storage capacity of the system 32.

As previously described, when the operator directs particular lighting levels to the individual lights, the unit 32 provides a unique and predetermined address signal corresponding to the light group to be controlled and a serial coded signal representative of the current level which is to be applied to the particular light group. In accordance with the present invention, receiver means 44 is provided for applying the current level to the power dimmer of each light group only in response to a particular address signal and at a level prescribed by the particular binary-coded data signal. The receiver means 44 preferably is in the form of the circuit shown in FIG. 10. More particularly, the unit 32 provides two parallel signals over two lines of bus 38, one a clocking signal CK at the input line 200 and the other an information signal, DATA, including the address and the current level information over data line 202. Specifically, the DATA signal includes word sets, each set including an ADDRESS word (to address a particular receiver circuit or circuits) and a DATA word (representative of the current level information). It is noted that the serial binary signals provided over the data line 202 are each synchronized with the clocking signal provided over line 200 so that each clocking pulse occurs at the very center of each data pulse to provide the most accurate reading. Those familiar with the art will appreciate that other forms of data transmission, particularly schemes where the CK and DATA signals are carried on a single wire could be employed. Line 200 and 202 are connected to the positive input terminals of comparators 206 and 204, respectively. The negative input terminals of comparators 204 and 206 are connected to the trimming pot 208 so as to adjust the threshold level of the comparator as well known in the art. Comparators are well known and generally when the voltage level at the positive input terminal exceeds that of the negative input terminal the output of the comparator provides a positive voltage. When the voltage at the positive input terminal falls below the voltage at the negative input terminal, the output of the comparator is zero volts. Thus, by properly adjusting the trimming potentiometer 208, the comparators 204 and 206 act to shape the pulses received over 200 and 202. Both of the outputs 204 and 206 are passed through a high frequency filter, generally indicated at 210 so as to remove any high frequency noise which may be provided. After passing through the high frequency filters, the output of comparator 204 provides the DATA input signal to the receiver while the output of comparator 206 provides the CK input to various points in the receiver circuit. The DATA and CK signals are provided to the shift register 214. Shift registers are generally well known in the art and generally the shift register is designed to hold the number of bits in each address word and each data word transmitted over line 202. Thus, where an address word contains eight bits of information, the signal is fed one bit at a time into the shift register 214 until all eight bits are contained in the register and are provided over the corresponding eight output lines 215. Each bit will be either in a high or low state depending on the particular address. Each of the bits appearing at the outputs 215 are simultaneously applied to an input of a corresponding one of the EXOR gates generally indicated at 216. An EXOR gate is provided for each bit of the address, so that by way of example, eight EXOR gates are shown for an eight bit address. The other input of each of the EXOR gates 216 is connected to an output of the address switching array 218 and to a corresponding one of a plurality of biasing resistors 220, which in turn, are all biased by a positive voltage. The switching array 218 includes eight switches each connected to a corresponding EXOR gate 216. When a switch is closed, the input of the corresponding EXOR gate 216 is connected to ground and thus the input is at a low logic level. However, if the switch is opened the particular input of EXOR gate 216 is biased by a positive voltage placing that particular input at a logic high level. In this manner, by preselecting those switches which should be closed, an address can be provided to the EXOR gates 216 which is compared to the address provided in the shift register 214. Thus, any receiver 44 can be made to respond to any controller 54 by setting the appropriate address in the switches 218. Each of the EXOR gates provides a low logic level if both inputs are high or both inputs are low. However, here one input is high and the other input is low, the output of the exclusive OR gate 216 changes from a low logic level to a high logic level. In this manner, the particular bit of an address word in shift register 214 is considered to match with the corresponding bit determined by the appropriate switch 218 when one is high and the other is low. By way of example, if switch 218A were open providing a high signal to the input of EXOR gate 216A and the corresponding bit in shift register 214 is at a low state, the output of EXOR gate 216A changes from low to high. The outputs of each of the EXOR gates 216 are connected to the inputs of AND gate 222. AND gate 222 provides a low signal output so long as at least one of its inputs is low. If, however, all of its inputs are high, indicating an address match has been made, the output of AND gate 222 is high. In this manner, the output of AND gate 222 is designated to enable AND gate 224 when an address match has been made.

The parallel output lines of the shift register 214 are also connected to the inputs of the NAND gate 226. The output of the latter is connected to the reset input of the JK flip-flop 230 (hereinafter called the start flip-flop). The latter has its clocking input connected so as to receive the CK signal from the output of the comparator 206. JK flip-flops are well known and thus flip-flop 230 and the several JK Flip-flops described hereinafter generally have a Q and $\overline{Q}$ outputs which are always opposite with respect to their logic state. Specifically, the Q and $\overline{Q}$ outputs will go high and low, respectively, when the signal at the J input goes high and a clocking signal appears at the clocking input. The outputs will remain in this state until the K input goes high and a clocking pulse is received at the clocking input of the flip-flop, whereupon the Q and $\overline{Q}$ outputs go low and high, respectively. A high signal applied to the set input of the flip-flop overrides the J and K inputs setting the Q and $\overline{Q}$ outputs, high and low respectively. In a similar manner, but opposite result, a high signal applied to the reset input of the flip-flop overrides the J and K inputs, resulting in the Q and $\overline{Q}$ outputs going low and high, respectively. The Q output of flip-flop 230 is connected to an input of NOR gate 232 with the other input of NOR gate 232 connected to the first bit output over line 215A of the register 214. The output of NOR gate 232 is connected to the J input of the JK flip-flop (hereinafter called the idle flip-flop) 234. The clocking input of flip-flop 234 is connected to receive the clocking signal through the inverter 225. The Q output of flip-flop 234 is connected to the J input of flip-flop 230. The $\overline{Q}$ output of flip-flop 234 is connected to the clearing and reset inputs of the decade counter 236. The clocking input of the latter is adapted to receive the inverted clocking signal from the inverter 225. Decade counter 236 counts the inverted clocking signal so that on the eighth count after the clearing and reset inputs receive a high signal, the eight output goes from low to high. Similarly, when the ninth clocking pulse occurs, the ninth output goes from low to high. The ninth output is connected to the K input of the JK flip-flop 234, while the eighth output is connected to AND gate 224.

The output of AND gate 224 is connected to the J input of JK flip-flop 238. The clocking input of flip-flop 238 is adapted to receive the inverted clocking signal from inverter 225. The $\overline{Q}$ output of flip-flop 238 is applied to the clearing and reset inputs of the decade counter 240, as well as to the set input of flip-flop 242. The J and K inputs of flip-flop 242 are connected to a positive voltage, while the reset input is connected to ground. The clocking input is connected to receive the clocking signal from the output of comparator 206 so that the $\overline{Q}$ output provides a clocking signal output (having half the pulse repetition rate of the clocking signal from comparator 206) when the set input to flip-flop 242 goes low. The $\overline{Q}$ output of flip-flop 242 is connected to the clocking input of decade counter 240. The fifth output of counter 240 is connected to the enabling inputs of latches 244 as well as the K input of JK flip-flop 238. After the clearing and reset inputs of decade counter 240 go high, the five output of decade counter 240 will go high on the fifth clocking pulse received at the clocking input of the counter. The high output from the output of counter 240 causes the $\overline{Q}$ output of flip-flop 238 to go high and enables the latches 244.

Latches 244, which may be in the form of D flip-flops, generally hold the values of the seven output lines of shift register 214 when the register is full and will hold these values at the output of the latches until an update is provided. The output of the latches are connected to digital-to-analog converters 246 which convert the digital outputs of the latches to a single analog voltage as represented by the digital signals. The voltage output of the digital-to-analog converter 246 is applied to the input of a comparator 250 which is provided with a feedback resistor 254 and connected to ground through trimming pot 252 so that comparator 250 functions as an operational amplifier. The output of the operational amplifier 250 is applied to the power dimmer as a voltage level which corresponds to the digital value held by latch 244.

In operation, the data and clocking signals are continuously provided over lines 202 and 200 respectively, as a serial stream of pulses and are applied to the inputs of the comparators 204 and 206, respectively. The comparators 204 and 206 provide the corresponding DATA and CK signals used in the receiver circuit. An example of a DATA signal provided at the output of comparator 204 is shown at the top of FIG. 11. Specifically, the stream shown comprises an IDLE word (indicating a space between two sets of words) preferably including eight bits, all high; a start bit; an eight-bit ADDRESS word indicating the particular receiver to which the subsequent DATA word is to be applied, two stop bits (to indicate a space between the address and DATA words), a start bit, a seven bit DATA word and a null bit. The next pulses following the last null bit are those of an idle word and a repeat of the same sequence except that the eight-bit ADDRESS word and seven-bit DATA word may each be a different series of high and low pulses. In this manner, all of the receiver circuits are sequentially addressed and the current level set by the particular data signal. After the entire sequence is completed, the sequence is automatically repeated. The system 32 is thus designed so that each receiver circuit is continuously updated whether a change in the current level to each power dimmer is made by the operator or not.

As the data stream is clocked into register 214, each bit is first provided over the output line 215A as shown in FIG. 11. When the next bit is clocked into the register, this next bit appears on line 215A, while the bit previously on line 215A appears on line 215B. The bits of the data stream are thus sequentially shifted from the output line 215A to 215H, one line at a time, each time the shift register receives a clocking pulse of the CK signal provided by the output of comparator 206. When all eight bits of the idle word are shifted into register 214 (the eighth pulse of the IDLE word thus appearing on the output line 215A) all of the outputs 215 will be high, enabling AND gate 226. The output of the latter goes high resetting the start flip-flop 230 whereby the Q output goes low. Since the K input, and as will be more evident hereinafter, the J input are both low, the fact that the reset input of flip-flop 230 goes low on the next pulse will not affect the Q ouput so that the latter remains low.

The next bit clocked into shift register 214 is the start bit, which appears between the IDLE and ADDRESS word and is always low. Thus, both inputs to NOR gate 232 are low and the output of the gate and thus the J input of the idle flip-flop 234 will be high. On the next clocking pulse, the Q output of flip-flop 234 and thus the J input of flip-flop 230 goes high, causing the Q output of the flip-flop 230 to go high. The resulting high output disables gate 232 so that the output of the gate goes low. When the Q output of flip-flop 234 goes high the $\overline{Q}$ output goes low allowing the decade counter 236 to begin counting the clocking pulses received from the inverter 225. While the counter is counting, the pulses of the address word are clocked into shift register 214. On the eighth count by the decade counter, if the address word matches the address as provided by the switching circuit 218, the outputs of the exclusive OR gates 216 will all be high enabling the AND gate 222. Simultaneously, the eighth output of counter 236 goes high so that gate 224 is enabled. The output of gate 224 thus goes high on the eighth count if there is an address match. The high output pulse of gate 224 is applied to the J input of flip-flop 238 so that on the next clocking pulse the $\overline{Q}$ output of flip-flop 238 goes low.

During this clocking pulse, the ninth output pulse counter 236 and thus the K input of the idle flip-flop 234 goes high so that on the next clocking pulse provided at the clocking input of the flip-flop 234, the Q and $\overline{Q}$ outputs of flip-flop 234 go low and high, respectively. The high $\overline{Q}$ output resets and clears counter 236, with the latter staying clear until the $\overline{Q}$ output goes low. The low Q output of flip-flop 234 is applied to the J input of flip-flop 230 which has no effect on the Q output of the latter flip-flop since the outputs of the flip-flop change state when a positive-going transition is applied to the J or K inputs.

Referring again to gate 224, when the latter is enabled and the j input of flip-flop 238 goes high, the $\overline{Q}$ output of the flip-flop goes low. This causes the set input of flip-flop 242 to go low. Since the J and K inputs of flip-flop 242 are both high, the flip-flop acts as a "divide-by-two" so that a pulse is provided at the $\overline{Q}$ output of flip-flop 242 for every two pulses provided at its clocking input. Further, since the $\overline{Q}$ output of the flip-flop is connected to the clocking input of decade counter 240, an additional clocking input pulse to flip-flop 242 is obtained so that on the eleventh clocking pulse to flip-flop 242, after the $\overline{Q}$ output of flip-flop 238 has gone low, the fifth output of counter 240 goes high. This high output is applied to the K input of flip-flop 238, whereupon on the next clocking pulse the $\overline{Q}$ output of flip-flop 238 goes high setting flip-flop 242 and resetting counter 240. During the counting period of counter 240, the two stop bits, start bit and DATA word are sequentially clocked into the register 214. When the fifth output of counter 240 goes high, the data word appears on lines 215B–215H. The high output of counter 240 enables the latch 244 so that the data word on lines 215B-H is transferred into the latch and held until the next update is received. The values held in latch 244 also appear at the inputs of the digital-to-analog converter 246 where the seven digital signals are converted to a single analog voltage signal and applied to the op amp 250. The op amp 250 amplifies the signal and applies it to the particular power dimmer to which th receiver circuit is attached.

The light dimming system of the present invention is designed to provide the traditional functions of the prior art system of FIG. 1, without some of its disadvantages previously noted.

First, each controller 54 is used for proportional control of one of the corresponding light groups. This can be accomplished by switching the MOP switch of the particular light group to manual and moving the particular controller between the 0 and 1 position so as to provide the relative intensity level desired. In this manner during a period, such as a rehearsal, when the various lighting levels of the light groups are being determined, the various lighting levels for each light group for a particular cue can easily be determined by switching all of those MOP switches involved to the manual position. Once the individual settings are satisfactory, the preset switch 150 is set to the particular preset number (which provides a unique combination of high and/or low signals over the lines 152, 154, 156 and 158 shown in FIG. 9), with a different preset number being used for each cue. In order to store the particular settings of all the lights on the stage, the stage store switch 102 is pushed, so that the output of NAND gate 132 goes low when enabled from system 32 in a manner previously described with reference to FIG. 8.

One can store the manual settings of the controllers without affecting the lights on the stage. For example, one may wish to store a different intensity value of a particular light group without affecting the value of the inytensity of this same light group on the stage. In order to accomplish this, the MOP switch for the particular light group is set in the preset mode so that subsequent movement of the particular handle 56 of the controller 54 has no affect on the light group on the stage. By moving the preset selector 150 to a different number (which in and of itself has no effect on the light group on the stage) and pushing the manual store switch 100, a low signal is provided at the output of NAND gate 130, indicating to system 32 that the settings of the controllers 54 are to be stored in memory at the preset number indicated by the preset selector.

In order to completely fade in or fade out all of the lights on the stage whose corresponding MOP switches are set to manual, the manual master fader 52 is used. The latter acts as a proportional fader so that in the 1 position of its handle, the current levels provided to all of the light groups are at levels set by the corresponding controllers 54 while all of the lights proportionally decrease to zero when the manual master fader handle is moved to the zero position. This is of particular use when fading in and out of scenes on the stage.

When it becomes desirable to utilize the cues stored into the memory of system 32, this is easily accomplished by putting the MOP switches 82 for each of the corresponding controllers 54 in the preset mode and using the load switches 100A and 102A, respectively, together with the master faders 50A and 50B. specifically, a cue previously stored in memory is selected by the cue selector 150. By pressing the load swtich A 100A, the cue is loaded into the register A of the system 32 and is controlled by the master fader 50A. The master fader 50A is moved from the 0 position where the levels stored in the register 33A have no effect on the light groups to the position 1 where the current levels provided to all of the lights are those previously entered into storage. Similarly, by changing preset selector 150 and pressing the load switch 102A, another cue is loaded from memory into the register B of the system 32 and is controlled by the master fader 50B. Moving swtich 50B from the 0 position similarly results in the fading in of the current levels of all the lights set when the cue was entered into the memory. The light control system is designed to add the intensity setting of a light group stored in register 33A multiplied by the proportional setting of the master fader 50A to the intensity setting of the light group stored in register B multiplied by the proportional setting of the master fader 50B. Thus, for example, where a particular light group is set so that each light of the group receives one amp at full intensity, the current varies from zero to 1 amp as the handle 56 of the master fader 50A is moved from the 0 to 1 position. Similarly, each lamp of the group might be adapted to received two amps from the setting in register B, as the handle 56 of the master fader 50B is moved from the 0 to 1 position.

Since both master faders 50A and 50B are mounted oppositely to one another, i.e. the 0 position of master fader 50A is placed adjacent the 1 position of the master fader 50B, and vice versa, cross fading (switching from one cue to the next) can easily be accomplished. Specifically, the first cue is selected on the selector 150 and entered into the register A by pushing the load switch A. If the master fader 50A is in the zero position, the light groups controlled by the cue will not be affected since the fader 50A is a proportional fader. The fader 50A is then moved to the 1 position to provide the maximum intensity to each of the light groups as previously set in the cue preset. For example, the lights of one group might receive one amp each. The next cue is selected on the selector switch 150 and entered into register B by pushing the load switch B. This will have no effect on the values in register A, and if the master fader 50B is set at the zero position, it will have no effect on the light groups. Since the master faders are mounted opposite to one another, where one handle is positioned in the 1 position and the other in a 0 position, cross fading can be achieved from the cue in register A to the cue in register B by moving the two handles of faders 50A and 50B together to the 0 and 1 positions, respectively. If the particular light group previously set at 1 amp is to be changed to 2 amps, it will be obvious that a substantially smooth transition between the two will occur. This is illustrated by the following example whereby the handles of the faders 50A and 50B are moved from the 1 and 0 positions, respectively, to the 0 and 1 positions respectively. At the one quarter position, the value of current to the particular light group described will be 75 percent of the value in register A plus 25 percent of the value in register B ($1\frac{1}{4}$ amps). Halfway the value of the current level of the particular light group will be 50 percent of the value in register A plus 50 percent of the value of register B ($1\frac{1}{2}$ amps). Three quarters of the way, the value of the current level of the light groups described will be 25 percent the value in register A plus 75 percent of the value in register B ($1\frac{3}{4}$ amps). Finally, at the final position, the light groups will simply equal the value provided in register B (2 amps).

The master faders 50A and 50B can also be used to add two cues. This latter functions is achieved by moving both the master faders to the 1 position so that both presets entered in registers A and B are added and subsequently provided to the receivers 44. This might be advantageous where, for example, one register contains a particular cue which is not particularly strong in a red color. By presetting a separate cue with higher lighting levels of red lights, the latter cue can be loaded into a second register and the red can be faded in and out without necessarily affecting the first cue.

Further, after a particular light group of a cue has been placed in one of the registers, and faded in by moving the particular master fader, it may be desirable to change the cue, where for example, an actor or actress appears in th wrong position on the stage. The operator can make adjustments by moving the particular controller 54 related to the particular light groups with the corresponding MOP switches set in the preset position so that the movement of the controller has no effect on the light group. When the particular intensity is set by the position of the particular controller involved, the corresponding MOP switch is moved to the manual position which results in the controller 54 overriding the value in the register but not changing the preset values originally stored in the memory.

If it should prove desirable to change a cue stored in memory the MOP switches of all of the lights involved in the cues are set in the preset position. The corresponding controllers 54 are then moved to the various positions taking into consideration the changes and the manual store switch is then pressed. The new cue can override the old cue in which the changes are made in memory to those light groups whose current levels are changed, or the entire cue can be stored in memory under a different preset number.

Finally, it may be desirable to store a proportional level of all the current levels of a particular cue, where for example, the right color blend is achieved, but a less intense lighting effect is needed. This can easily be accomplished by providing the particular cue on the stage by loading a previously stored cue from memory into a register of the system. The corresponding master fader is set at the intermediate position between the 0 and 1 position where the particular intensity levels are achieved. The new preset number is selected on the selector 150 and the correponding master fader store switch 104 or 106 is then pushed to store the corresponding proportional setting determined by the position of the respective master fader 50A and 50B respectively.

As is obvious from the foregoing description, to a person skilled in the art, the present invention provides an improved light control system, operable from a central console, requiring a relatively small amount of space, generating little or no heat, and providing greater immunity from dirty environments. Further, the system provides substantially less power consumption than some prior art systems. Further, the use of a single input bus 36 and output bus 38 provides the advantage that substantially less wire is required. Additionally, the use of unique address and data word transmission over the single bus 38 allows the addition of as many receivers as desired without appreciably increasing the amount of wire needed. Finally, where it is desirable to control two lights on opposite sides of the stage with the same controller 54, one merely needs to provide the same address for the receivers of the two lights.

Since certain other changes may be made in the above-described apparatus without departing from the scope of the invention herein involved, it is intended that all matter contained in the above description or shown in the accompanying drawings, shall be interpreted in the illustrative and not in a limiting sense.

What is claimed is:

1. A system for controlling the light intensity level of a light group including one or more lights, said system comprising, in combination:

control means for generating a parallel binary-coded signal representative of a predetermined signal level to be applied to said light group;

signal generating means for generating a unique and predetermined serially-coded address signal corresponding to said light group and for generating a serially-coded data signal representative of said signal level in response to said parallel binary-coded signal;

receiver means for applying said signal level to said light group only in response to said address signal and said data signal; and a common bus for transmitting said address and data signals from said signal generating means to said receiver means.

2. A system in accordance with claim 1, wherein said control means includes switching means movable between a first position wherein said parallel binary-coded signal is representative of a preselected minimum signal level and a second position wherein said parallel binary-coded signal is representative of a preselected maximum signal level.

3. A system in accordance with claim 2 wherein said control means including a plurality of said switching means, said plurality of switching means being connected to said signal generating means by a common control bus, wherein each of said plurality of switching means generates a parallel binary-coded signal to said signal generating means on said common bus.

4. A system in accordance with claim 2 wherein said switching means includes a photomask having a plurality of tracks, and means including an array of photosensitive elements disposed on one side of said photomask and movable between said first and second positions so that said photosensitive elements can be selectively energized depending upon the position of said elements relative to said tracks of said photomask.

5. A system in accordance with claim 2 wherein said generating means generates as a pair each address signal with the data signal to be applied to the receiver means responsive to the address signal of said pair.

6. A system in accordance with claim 5 further comprising a plurality of said switching means, each for generating a parallel binary-coded signal representative of a predetermined signal level to be applied to a different one of said light groups, and a plurality of said receiver means, each of said receiver means being responsive to a predetermined address signal, wherein said signal generating means generates a different address signal and a data signal representative of the signal level of the parallel binary-coded signal for each of said switching means.

7. A system in accordance with claim 4 wherein said receiver means comprises latch means for holding a data signal; means responsive to the data signal held by said holding means, for applying said signal level to said light group; address means for comparing each address signal, generated by said signal generating means and transmitted over said common bus, with the unique and predetermined address to which said receiver means is responsive and for generating an enabling signal only when the address signal transmitted is the same as said unique and predetermined address; wherein said latch means is responsive to said enabling signal for holding the data signal accompanying said address signal when said address signal is the same as said unique and predetermined address.

8. A system in accordance with claim 7 wherein said signal generating means further comprises memory means for storing signals, each representative of a signal level to be applied to a particular light group.

9. A system in accordance with claim 8 wherein said plurality of switching means includes master switching means for proportionately increasing or decreasing all the signal levels applied to each of said light groups.

10. A system in accordance with claim 8 wherein said signal generating means further comprises at least two registers, each for holding a plurality of said store signal, each representative of a signal level to be applied to a different light group, means for transferring said signals between said registers and said memory means.

11. A system in accordance with claim 10 wherein said plurality of switching means includes at least two master switching means, each for proportionally increasing or decreasing all of the signal levels applied to each of said light groups as determined by said store signals in a corresponding one of said registers.

12. In a light control system for generating a parallel binary-coded signal representative of a light intensity signal level to be applied to a light group of one or more lights, an improved switching device comprising in combination:

manually adjustable means movable between a first position, wherein said parallel binary-coded signal is representative of a preselected minimum light intensity signal level and a second position wherein said parallel binary-coded signal is representative of a preselected maximum level;

a Gray-coded photomask having a plurality of tracks;

means including an array of photosensitive elements corresponding to the number of tracks of said photomask disposed on one side of said photomask and movable with said manually adjustable means between said first and second positions so that said photosensitive elements are capable of being selectively energized to produce a parallel gray-coded output signal the values of which depend upon the position of said elements relative to said tracks of said photomask; and means for converting said parallel Gray-coded output signal into said parallel binary-coded signal.

13. In a light control system including means for generating a serial binary-coded signal including a first portion representative of a light intensity signal level to be applied to a predetermined light group of one or more lights and a second portion representative of said predetermined light group, an improved device comprising:

register means for receiving said serial binary-coded signal one bit at a time and for converting the part of said serial binary-coded signal in said register to a corresponding parallel binary-coded signal;

clocking means for clocking said first and second portions of said signal into said register means;

means for encoding said device with a predetermined binary-coded address;

comparator means for comparing said second portion of said signal with said predetermined binary-coded address when said second portion of said signal is present in said register means and for generating a first enable signal only when the binary-coded sequence of said second portion matches said predetermined binary-coded address;

means responsive to said first enable signal for generating a second signal when said first portion of said signal is present in said register means;

converter means for converting said first portion of said signal to an analog signal substantially equal to the light intensity signal level represented by said first portion; and gating means responsive to said second enable signal for transmitting said first portion of said signal to said converter means.

14. A system for controlling the light intensity level of a light group including one or more lights, said system comprising, in combination:

control means for generating a parallel binary-coded signal representative of a predetermined signal level to be applied to said light group, said control means including manually adjustable means movable between a first position, wherein said parallel binary-coded signal is representative of a preselected minimum light intensity signal level and a second position wherein said parallel binary-coded signal is representative of a preselected maximum level; and a photomask having a plurality of tracks, means including an array of photosensitive elements corresponding to the number of tracks of said photomask disposed on one side of said photomask and movable with said manually adjustable means between said first and second positions so that said photosensitive elements are capable of being selectively energized to produce a coded output signal, the values of which depend on the position of said photosensitive elements relative to said tracks of said photomask; and means for converting said coded output signal into said parallel binary-coded signal;

signal generating means for generating a unique and predetermined serial-coded address signal corresponding to said light group and generating a serially-coded data signal representative of said signal level in response to said parallel binary-coded signal;

receiver means for applying said signal level to said light group only in response to said address signal and said data signal, said receiver means including register means for receiving said address and data signals from said signal generating means one bit at a time and for converting each of said signals to parallel binary-coded form, clocking means for clocking said address and data signals into said register means, means for encoding said receiver means with a predetermined binary-coded address, comparator means for comparing said address signal with said predetermined address when said address signal is present in said register means and for generating a first enable signal only when the binary-coded sequence of said addresss signal matches said address, means for generating a second enable signal only in response to said first enable signal when said data signal is present in said register converter means for converting said data signal to an analog signal substantially equal to the light intensity level represented by said data signal, and gating means responsive to said second enable signal for transmitting said data signal to said converter means; and a common bus for transmitting said address and data signals from said signal generating means to said receiver means.

15. A method of controlling the light intensity level of a light group including one or more lights, said method comprising the steps of:

generating a parallel binary-coded signal representative of a predetermined signal level to be applied to said light group;

generating a unique and predetermined serially-coded address signal corresponding to said light group and a serially-coded data signal representative of said signal level in response to said parallel binary-coded signal;

transmitting said address and data signals from said signal generating means to said light group over a common bus; and applying said signal level to said light group only in response to said address signal and said data signal.

* * * * *

UNITED STATES PATENT OFFICE

CERTIFICATE OF CORRECTION

PATENT NO. : 4,095,139
DATED : June 13, 1978
INVENTOR(S) : Alan P. Symonds and William K. Durfee It is certified that error appears in the above-identified patent and that said Letters Patent are hereby corrected as shown below:

Claim 3, Column 19, Line 28, "including" should be -- includes --;

Claim 13, Column 21, Line 4, "enable" should be inserted after the word "second";

Claim 14, Column 22, Line 15, "addresss" should be -- address --.

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*

US004095139B1

REEXAMINATION CERTIFICATE (3252th)

United States Patent [19] [11] B1 4,095,139

Symonds et al. [45] Certificate Issued Jul. 8, 1997

[54] LIGHT CONTROL SYSTEM

[75] Inventors: Alan P. Symonds, Needham Heights; William K. Durfee, Cambridge, both of Mass.

[73] Assignee: Vari-Lite, Inc.

Reexamination Request:
No. 90/003,188, Sep. 7, 1993

Reexamination Certificate for:

| | |
|---|---|
| Patent No.: | **4,095,139** |
| Issued: | **Jun. 13, 1978** |
| Appl. No.: | **798,259** |
| Filed: | **May 18, 1977** |

Certificate of Correction issued Nov. 28, 1978.

[51] Int. Cl.[6] ..... H05B 37/02

[52] U.S. Cl. ..... 315/153; 315/158; 315/293; 315/294; 315/315

[58] Field of Search ..... 315/153, 158, 315/293, 294, 315, 154, 159, 291, 314, 316

[56] References Cited

U.S. PATENT DOCUMENTS 3,845,351 10/1974 von Ballmoos ..... 315/293

FOREIGN PATENT DOCUMENTS

2222435C2 11/1972 Germany .

OTHER PUBLICATIONS

*Microprocessor Applications Manual* (McGraw–Hill Book Co. 1975), pp. 1–1 to 1–9, 2–26 to 2–29, 3–1, 3–8 to 3–37.

Richard E. Gasperini, *Digital Troubleshooting* (Movonics Co. 1975, 1976), pp. 4–10, 4–11.

Epperson, Dirk. *A Digital Lighting System for the Theater* (submitted to the Faculty of the Yale School of Drama in partial fulfillmenet of the requirements for the Degree of Master of Fine Arts in Theater Engineering 1974).

McGowan, T.K. and Felker, G.E. *A New Approach to Lighting System Control*, Journal of IES Oct. 1976 at 38.

An Introduction to the Mega–Cue Memory Lighting Control System (exact publication date unknown, but system may have been used publicly in Feb. 1977).

IBM Synchronous Data Link Control General Information, 2nd edition, May 1975.

Safford, Edward L., Jr. *The Complete Handbook of Robotics*, 206–218 (TAB BOOKS Inc. 1978).

Pilbrow, R. *Stage Lighting* (Drama Book Specialists, 1979).

Pilbrow, R. *Stage Lighting* (Litton Educational Publishing, Inc., 1971).

Bose, K.W. *Video Security Systems* (Howard W. Sums and Co., Inc. 1976).

Sellman, H. D. *Essentials of Stage Lighting* (Meredith Corp. 1972).

Vertut, J. and Coiffet, P. *Robot Technology, Volume 3A, Teleoperations and Robotics* (Prentice–Hall 1986).

Baker, D.K. *Computer Controlled Stage Lighting*, Electrical Review, Jan. 1973; and British Cinematography Sound and Television, Mar., 1973.

Harris, R.M. *From Wax Candle to Floppy Disc*, Electrical Contractor, Sep. 1981.

Collins, W. *Computer Lighting for the Small Theater*, Computer Age, May 1980.

Pots, D. and Kellock, B. *Computers Keep the Show on the Road*, Machinery and Production Engineering, May 1979.

*Primary Examiner*—Robert Pascal

[57] ABSTRACT

A light control system for selectively controlling the light intensity levels of a plurality of light groups, each group including one or more lights, is disclosed. The system comprises a control for generating a parallel binary-coded signal representative of a predetermined current level to be applied to a particular light group; a signal generator for providing (1) a unique and predetermined serially-coded address signal corresponding to the particular light group and, (2) a serially-coded data signal representative of the current level in response to the parallel binary-coded signal, and; a plurality of receivers, at least one for each light group for applying the current level to the particular light group only in response to the address signal and data signal. A common wire bus for transmitting the address and data signals from the signal generator to each of the receivers is utilized to substantially reduce the wiring required.

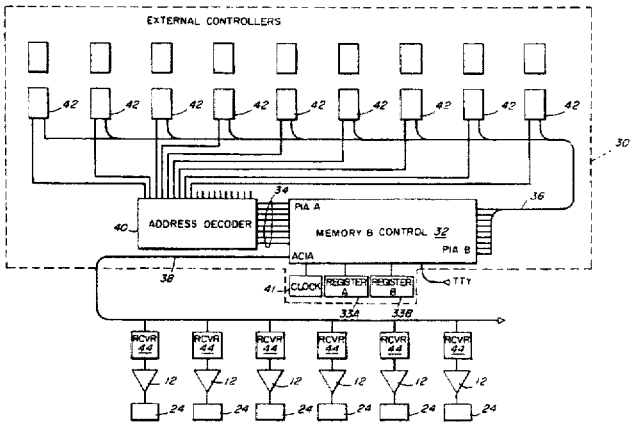

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 12–14 is confirmed.

Claims 1–3, 5, 6 and 15 are cancelled.

Claim 4 is determined to be patentable as amended.

Claims 7–11, dependent on an amended claim, are determined to be patentable.

New claims 16 and 17 are added and determined to be patentable.

4. A system [in accordance with claim 2] *for controlling the light intensity level of a light group including one or more lights, said system comprising, in combination:*

*control means for generating a parallel binary-coded signal representative of a predetermined signal level to be applied to said light group;*

*signal generating means for generating a unique and predetermined serially-coded address signal corresponding to said light group and for generating a serially-coded data signal representatives of said signal level in response to said parallel binary-coded signal;*

*receiver means for applying said signal level to said light group only in response to said address signal and said data signal;*

*a common bus for transmitting said address and data signals from said signal generating means to said receiver means;*

*wherein said control means includes switching means movable between a first position wherein said parallel binary-coded signal is representative of a preselected minimum signal level and a second position wherein said parallel binary-coded signal is representative of a preselected maximum signal level; and* wherein said switching means includes a photomask having a plurality of tracks, and means including an array of photosensitive elements disposed on one said of said photomask and movable between said first and second positions so that said photosensitive elements can be selectively energized depending upon the position of said elements relative to said tracks of said photomask.

*16. A system for controlling the light intensity level of a light group including one or more lights, said system comprising, in combination:*

*control means for generating a parallel binary-coded signal representative of a predetermined signal level to be applied to said light group;*

*signal generating means for generating a unique and predetermined serially-coded address signal corresponding to said light group and for generating a serially-coded data signal representative of said signal level in response to said parallel binary-coded signal;*

*receiver means for applying said signal level to said light group only in response to said address signal and said data signal, said receiver including a digital processor developing a first enable signal when said address signal is received and a second enable signal for processing said data signal; and*

*a common bus for transmitting said address and data signals from said signal generating means to said receiver means.*

*17. A method of controlling the light intensity level of a light group including one or more lights, said method comprising the steps of:*

*generating a parallel binary-coded signal representative of a predetermined signal level to be applied to said light group;*

*generating by signal generating means a unique and predetermined serially-coded address signal corresponding to said light group and a serially-coded data signal representative of said signal level in response to said parallel binary-coded signal;*

*transmitting said address and data signals from said signal generating means to said light group over a common bus; and*

*receiving said signals and generating first and second enable signals in response to reception of said address and data signals to enable the applying of said signal level to said light group only in response to said address signal and said data signal.*

* * * * *